United States Patent [19]

Watson

[11] 4,364,589

[45] Dec. 21, 1982

[54] PYROLYTIC LATCH ASSEMBLY HEAT COVER FOR RANGES

[75] Inventor: Howard E. Watson, Marion, Ohio

[73] Assignee: Whirlpool Corporation, Benton Harbor, Mich.

[21] Appl. No.: 197,568

[22] Filed: Oct. 16, 1980

[51] Int. Cl.[3] ..... E05C 5/02

[52] U.S. Cl. ..... 292/113; 297/15; 126/197

[58] Field of Search ..... 292/113, DIG. 66, DIG. 69, 292/1; 297/15; 126/197, 273

[56] References Cited

U.S. PATENT DOCUMENTS

| | | | |
|---|---|---|---|
| 1,999,299 | 4/1935 | Lowry et al. | 200/138 |
| 2,244,349 | 6/1941 | Rickmeyer | 200/139 |
| 2,265,026 | 12/1941 | Clark | 297/15 |
| 3,406,677 | 10/1968 | Anderson | 126/197 |
| 3,416,515 | 12/1968 | Mertler | 126/273 |
| 3,438,666 | 4/1969 | Erickson | 292/210 |
| 3,540,767 | 11/1970 | Siegel | 126/197 X |
| 3,883,717 | 5/1975 | Del Percio | 219/328 |

*Primary Examiner*—Richard E. Moore

*Attorney, Agent, or Firm*—Wegner, McCord, Wood & Dalton

[57] ABSTRACT

Structure for locking a latching mechanism provided for controlling the opening of a range oven door selectively closing an oven cavity, so as to prevent the opening thereof when the oven cavity is at a high temperature such as during a pyrolytic self-cleaning operation. The locking device includes a thermal sensor which is caused to be disposed in accurate correlated relationship to the oven wall outwardly thereof as a result of a housing associated with the thermal sensor being secured to the oven wall. Resultingly, the sensor is retained in accurate preselected heat transfer association with the oven cavity while being free of exposure to fumes and gases generated in the oven cavity.

12 Claims, 4 Drawing Figures

FIG. 1
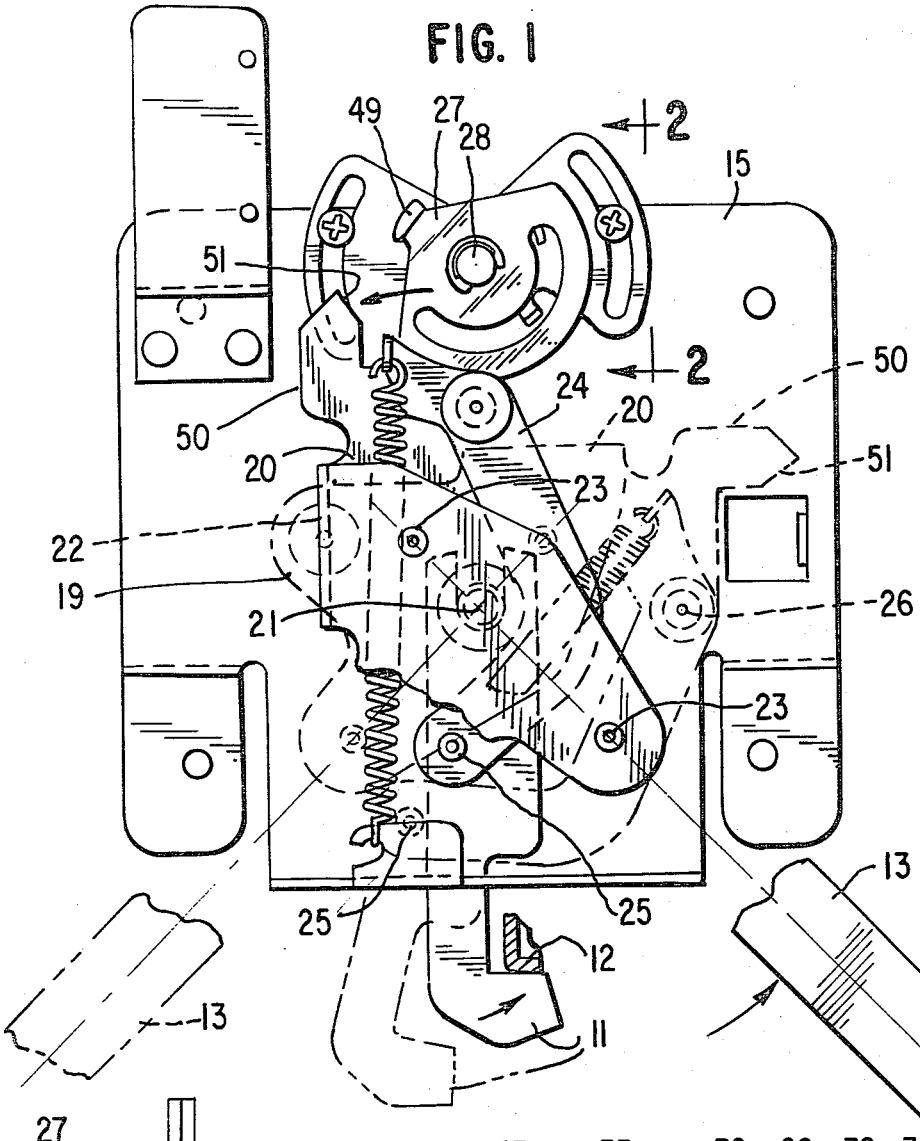
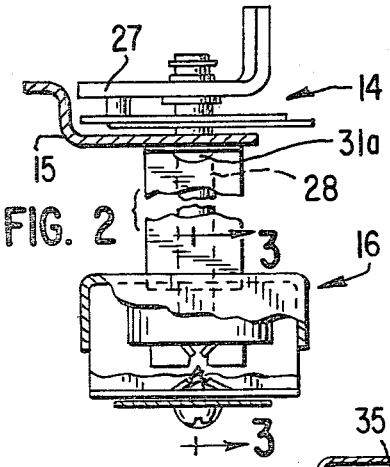
FIG. 2
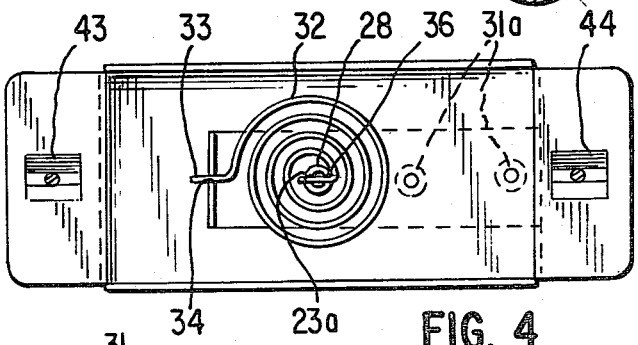
FIG. 4
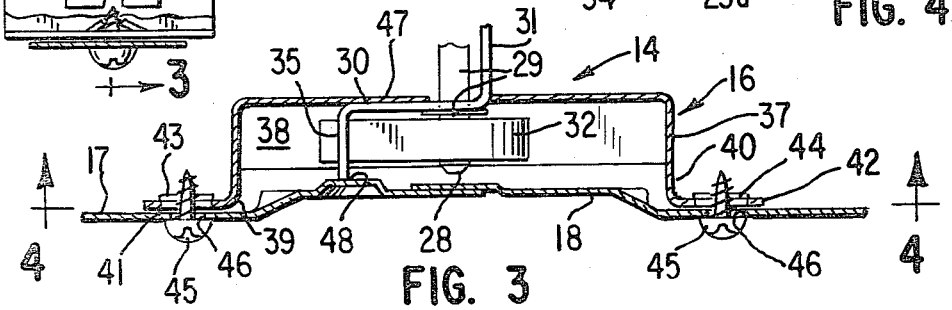
FIG. 3

PYROLYTIC LATCH ASSEMBLY HEAT COVER FOR RANGES

BACKGROUND OF THE INVENTION

1. Field of the Invention

This invention relates to oven cleaning devices and in particular to means for effectively locking the oven door latching mechanism during a high temperature pyrolytic cleaning operation.

2. Description of the Background Art

In one known form of latching mechanism for use in controlling the opening of a door to a self-cleaning oven, a locking device is provided for maintaining the door latch in the latching condition whenever the temperature of the oven is above a preselected temperature, such as occurs during the self-cleaning operation. In one illustrative form of such mechanism, an operating handle is provided which extends outwardly for manipulation by the user. The operating handle normally provides means for controlling the latched condition of the oven door. The locking means is associated with the latching mechanism so as to prevent manipulation of the handle under such high temperature conditions.

One illustrative example of such a latching mechanism is shown in U.S. Pat. No. 3,438,666 of Karl H. Erickson. As illustrated in the Erickson patent, the locking means includes a blocking member rotated into and out of blocking relation with the latch under the control of a bimetallic heat sensing coil. The coil is separated from the oven wall insulation by a shroud arranged to cause the lower side of the coil to be exposed directly to the heat in the oven chamber. Thus, the coil is subject to fumes and gases generated during the cleaning operation.

Another U.S. Letters Patent showing a combination mechanical-thermal latch mechanism for use in a range oven is that of Carl. L. Anderson, U.S. Pat. No. 3,406,677. The Anderson structure is similar to that of the Erickson structure in the provision of a hole in the oven top subjacent the bimetal sensor element, permitting the sensor element to be subjected to the fumes and gases of the oven cavity in order to provide the desired sensing of the oven temperature.

Charles S. Mertler shows in U.S. Pat. No. 3,416,515 another form of door latching actuator assembly for use in controlling the opening of the door as during a high temperature self-cleaning operation of the oven. The temperature responsive mechanism of the Mertler patent includes a cylinderical housing having a bimetallic snap-acting disc disposed adjacent a lowermost end wall. The disc is retained in the housing by a ring or clips which are spot-welded to the housing.

Still another form of thermostatic mechanism for use in an electric range is shown in U.S. Pat. No. 2,265,026 of Earl K. Clark. The Clark thermostat includes a temperature compensator for independently adjusting the thermostat to maintain the oven temperature constant.

SUMMARY OF THE INVENTION

The present invention comprehends an improved locking means for use with an oven door latching mechanism which is extremely simple and economical of construction while yet providing substantially improved control of the mechanism in preventing opening of the oven door under high temperature conditions of the oven.

More specifically, the invention comprehends the provision in a latching mechanism having a latch assembly, locking means for locking the latch assembly, a heat sensor, mounting bracket means for supporting the sensor in the mechanism, and means responsive to the sensor for operating the locking means as a result of the sensor sensing a preselected high temperature of an adjacent wall. The improved locking means includes wall means housing the sensor and having a force transfer portion engaging the mounting bracket means, and means for securing the wall means to the wall with the force transfer portion as a result of the wall means being secured to the wall urging the mounting bracket means to a preselected disposition relative to the wall to dispose the heat sensor supported by the mounting bracket means in a preselected thermal transfer spaced relationship to the wall for causing operation of the locking means in accurate correlation with the wall temperature.

In the illustrated embodiment, the mounting bracket is clamped between the force transfer portion and the wall.

In the illustrated embodiment, the securing means urges the cover into engagement with the wall so as to define a heat transfer space in which the sensor is disposed.

The mounting bracket extends through the space into engagement with the wall.

In the illustrated embodiment, the wall means includes a first concave portion enclosing the sensor and defining a force transfer means for engaging the mounting bracket means. A second securing portion projects from the concave portion of the wall means to be secured to the oven wall so as to bring the mounting bracket into preselected abutment with the oven wall in providing the desired accurate positioning of the sensor element.

In the illustrated embodiment, the securing portion of the housing defines a pair of legs at opposite ends of the concave portion thereof. The legs may be provided with integral female securing means for cooperating with conventional male screw elements or the like in securing the housing to the oven wall.

The sensor mounting bracket may extend fully through the cavity of the housing so as to have one end urged into abutment with the oven wall as a result of the securing of the housing to the oven wall.

In the illustrated embodiment, the bracket includes a turned portion within the concave housing portion which has facial abutment with the force-applying portion of the housing in the secured arrangement of the device.

BRIEF DESCRIPTION OF THE DRAWING

Other features and advantages of the invention will be apparent from the following description taken in connection with the accompanying drawings wherein:

FIG. 1 is a plan view of the latching mechanism having an improved locking means embodying the invention, the operating handle of the mechanism being shown in an open position in broken lines and in a closed position in full lines;

FIG. 2 is a vertical section taken substantially along the line 2—2 of FIG. 1 showing in greater detail the locking means;

FIG. 3 is a partial transverse section thereof taken substantially along the line 3—3 of FIG. 2; and FIG. 4 is a bottom plan view taken substantially along line 4—4 of FIG. 3.

DESCRIPTION OF THE PREFERRED EMBODIMENT

In the exemplary embodiment of the invention as disclosed in the drawings, a latching mechanism generally designated 10 is provided with a latch member 11 selectively engaging a cooperating strike portion 12 of an oven door or the like for selectively latching the door in a closed position. Mechanism 10 includes a handle 13 which is manually operable between an unlatched position shown in broken lines in FIG. 1 and a latched position shown in full lines in FIG. 1. The corresponding unlatched position of latch member 11 is shown in broken lines in FIG. 1 and the latched position thereof is shown in full lines. The latching mechanism is generally similar to the latching mechanism illustrated in U.S. Pat. No. 3,438,666 discussed above. The invention herein, as shown in FIGS. 2, 3 and 4, is concerned more specifically with the provision of improved means generally designated 14 for locking the latching mechanism in the closed position of FIG. 1 when the temperature within the associated oven cavity reaches a preselected high temperature. As discussed above, a number of background art devices have been developed for controlling the locking of such mechanisms and the present invention comprehends an improved form of such locking means.

Briefly, latching mechanism 10 is carried on a supporting base 15 adapted to be mounted to the upper oven cavity wall, as illustrated in U.S. Pat. No. 3,438,666. The locking mechanism includes a sensor structure generally designated 16 which is mounted to the liner 17 of the oven cavity in registration with a raised heat transfer portion 18 thereof.

Handle 13 is provided with an upper plate 19 and a lower plate 20. The lower plate is pivotally connected to base 15 by a rivet 21 and to the upper plate by a vertical wall member 22. The handle is secured to the top plate 19 by suitable rivets 23.

Motion of the handle is transmitted through a driving link 24 having one end connected to the latch member 11 by a rivet 25 and at its opposite end to the lower plate 20 by a rivet 26.

Latch member 11 is mounted for compound pivoting and sliding movement in effecting the desired movement thereof between the latched and unlatched positions illustrated in FIG. 1.

Movement of the latching member 11 from the full line latching position of FIG. 1 to the broken line unlatched position is prevented by operation of the locking means 14 when the temperature sensed by the sensor structure 16 is above a preselected high temperature. Locking means 14 includes a locking element 27 which is rotated into locking relationship with the latching mechanism in response to rotation of a shaft 28 extending from the sensor structure 16. The blocking member is secured to the upper end of the shaft 28 for direct rotation therewith.

As illustrated in FIGS. 2 and 3, the shaft extends downwardly into sensor structure 16 and includes a lower end portion 29 which is journaled in a turned portion 30 of a mounting bracket 31 secured to the baseplate 15 by rivets 31*a*.

Sensor structure 16 includes a spiral bimetallic sensor coil 32 having a turned end 33 received in a notch 34 in a downturned distal end portion 35 of bracket 31. The inner end 36 of the sensor coil is fixed in a slot 28*a* in the shaft 28, as illustrated in FIG. 4. Resultingly, expansion and contraction of the thermal sensing coil as a function of the temperature sensed thereby causes corresponding rotation of shaft 28 for selectively positioning the locking element 27. The present invention is concerned with the positioning of the sensor coil to accurately sense the temperature of the oven cavity so as to provide an accurate correlation of the temperature thereof with the latching mechanism locking function.

Such improved functioning is obtained herein by the provision of a cover or wall means 37 over the coil 32 for effectively defining a sensing space 38 in which the coil is protectively disposed. The cover, as seen in FIG. 3, is elongated and is provided at its opposite ends with downwardly extending legs 39 and 40 provided respectively with outturned distal portions 41 and 42. The distal portions, in turn, are provided with integrally formed female screw connecting means 43 and 44, respectively.

Legs 39 and 40 are firmly secured to the liner 17 by suitable screws 45 extending through suitable openings 46 in the liner to permit the screws to extend upwardly into threaded engagement with the female means 43 and 44, thereby drawing the cover 37 tightly downwardly into abutment with the liner 17.

As further illustrated in FIG. 3, cover 37 includes a central portion 47 effectively defining a force-applying portion of the cover drawn into abutment with the bracket portion 30 as a result of the downward urging of the cover by screws 45 when the cover is secured to the liner 17 as discussed above. The invention comprehends the provision of the distal end 35 of bracket 31 to have a preselected length such that the downward movement of the force-applying portion 47 causes the bracket portion 35 to engage a boss 48 on the heat transfer portion 18 of liner 17, thereby accurately positioning the bracket portion 30 to which the sensor coil 32 is mounted, as shown in FIG. 4. Such accurate positioning of the sensor coil provides an accurate spaced relationship thereof with the heat transfer portion 18 of the liner so as to provide an accurate correlation of the oven temperature with the temperature sensed by the sensor coil and thereby providing an accurate, correlated operation of the shaft 28 and locking means 14.

In the operation of the latching mechanism 10 and locking means 14, handle 13 is selectively positioned in the full line and dotted line positions of FIG. 1 by suitable manipulation thereof by the user when the temperature within the oven cavity is below a preselected value, such as approximately 600° F. In the full line position of handle 13, the latch member 11 is engaged with the strike plate 12, as illustrated in FIG. 1, to lock the oven door in a closed position. Movement of handle 13 to the dotted line position causes a compound pivoting and sliding movement of the latch member to the dotted line position shown in FIG. 1 free of the strike plate 12 to permit opening of the oven door.

Locking means 14 is brought into play as a result of the expansion of the spiral sensor coil 32 when the temperature sensed thereby rises above the preselected high temperature. More specifically, the locking element 27 is rotated into blocking relationship with the latching mechanism as a result of the rotation of shaft 28. At low temperatures, a lug 49 on locking element 27 is spaced angularly from an inner extension 50 of lower plate 20 so as to be positioned out of the path of movement of the extension 50 during the counterclockwise movement of the plate 20 as a result of the movement of the handle 13 from the unlatched position of the latched position shown in FIG. 1. As the temperature sensed by the coil 32 rises, the coil expands and unwinds so that the shaft 28 is rotated in a clockwise direction to bring the lug 49 into a position wherein it will block the counterclockwise movement of plate 20. The position of lug 49 is controlled solely by the thermally stretched condition of the sensor coil and, thus, the lug continues to move in a counterclockwise direction as the temperature of the oven rises above the preselected temperature to its maximum temperature which, in the illustrative embodiment wherein the oven is being heated to effect a pyrolytic cleaning operation, may be approximately 900° F. In the final position of the lug, it will become aligned, in the illustrated embodiment, with an abutment surface 51 of the extension 50 to effect a positive locking of the latching mechanism.

The present locking means 14 provides an improved accurate control of the locking of the latching mechanism as a function of the oven temperature as a result of the accurate spacing of the sensor coil 32 from the oven cavity wall heat transfer portion 18. As discussed above, such spacing is effected as a result of the construction of the locking means 14 correlated with the dimensions of the cover 37 and the mounting bracket leg 35. Cover 37 may comprise a low cost sheet metal element positively secured to the oven wall by sheet metal screws 45. Boss 48 may be accurately positioned relative to the oven cavity wall so as to provide the desired sensor clearance relative to the heat transfer wall portion 18 as a result of the leg 35 being firmly urged into abutment with boss 48 as a result of the cover being secured to the wall, as discussed above.

By virtue of forming the cover of sheet metal, a positive resilient biasing force may be applied from the portion 47 thereof to the turned portion 30 of the mounting bracket in effecting a positive maintained retention of the mounting bracket in the accurately disposed arrangement of FIG. 3. Resultingly, variation between manufactured units in the operation of the sensing elements is effectively eliminated while yet the improved locking structure is extremely simple and economical of construction.

The foregoing disclosure of specific embodiments is illustrative of the broad inventive concepts comprehended by the invention.

I claim:

1. In a latching mechanism having a latch assembly, locking means for locking the latch assembly, a heat sensor, mounting bracket means for supporting the sensor in the mechanism, and means responsive to the sensor for operating the locking means as a result of the sensor sensing a preselected high temperature of an adjacent wall, the improvement comprising:

a cover housing said sensor and having a force transfer portion engaging said mounting bracket means; and means for securing said cover to said adjacent wall with the force transfer portion, as a result of the cover being secured to said wall, urging said mounting bracket means to a preselected disposition relative to said wall to dispose said heat sensor supported by the mounting bracket means in a preselected thermal transfer spaced relationship to said wall for causing operation of the locking means in accurate correlation with the wall temperature.

2. The latching mechanism of claim 1 wherein said mounting bracket is clamped between said force transfer portions and said wall.

3. The latching mechanism of claim 1 wherein said securing means comprises means for urging said cover into engagement with said wall.

4. The latching mechanism of claim 1 wherein said cover cooperates with said wall when secured thereto by said securing means to define a heat transfer space in which said sensor is disposed.

5. The latching mechanism of claim 1 wherein said cover cooperates with said wall when secured thereto by said securing means to define a heat transfer space in which said sensor is disposed, said mounting bracket extending through said space into engagement with said wall.

6. In a latching mechanism having locking means, a heat sensor mounting bracket means for supporting the sensor in the mechanism, and means responsive to the sensor for operating the locking means as a result of the sensor sensing a preselected high temperature of an adjacent wall, the improvement comprising:

wall means having a concave portion enclosing said sensor and defining force transfer means for engaging said mounting bracket means, and a securing portion projecting from said concave portion; and means for securing said securing portion to said wall with the force transfer means as a result of the wall means being secured to said wall urging said mounting bracket means into a preselected abutment with said wall to dispose said heat sensor supported by the mounting bracket means in a preselected thermal transfer spaced relationship to said wall for causing operation of the locking means in accurate correlation with the wall temperature.

7. The latching mechanism of claim 6 wherein said securing portion comprises a pair of legs at opposite portions of the concave portion.

8. The latching mechanism of claim 6 wherein said concave portion defines end portions and said securing portion comprises a pair of legs on each of said end portions.

9. The latching mechanism of claim 6 wherein said concave portion defines end portions and said securing portion comprises a pair of legs on each of said end portions, each leg defining an integral female means for secured relationship with a male screw element.

10. The latching mechanism of claim 6 wherein said mounting bracket means comprises a bracket having a portion received within said concave portion of the wall means, a first end portion extending through the wall means, and a second end portion projecting from the concave portion toward said wall and comprising the portion of the bracket means urged into abutment with said wall.

11. The latching mechanism of claim 6 wherein said mounting bracket means comprises a bracket having a portion received within said concave portion of the wall means, a first end portion extending through the wall means, and a second end portion projecting from the concave portion toward said wall and comprising the portion of the bracket means urged into abutment with said wall, said portion within the concave portion of the wall means defining a force receiving portion engaged by said force transfer means.

12. The latching mechanism of claim 6 wherein said mounting bracket means comprises a bracket having a force receiving portion within said concave portion of the wall means, a first end portion extending through the wall means, and a second end projecting from the concave portion toward said wall and comprising the portion of the bracket means urged into abutment with said wall, said force receiving portion and said force transfer means respectively defining confronting surfaces brought into facial abutment as a result of the wall means being secured to said wall.

* * * * *